United States Patent [19]

Simonetto

[11] Patent Number: 5,024,075

[45] Date of Patent: Jun. 18, 1991

[54] METHOD OF DEFORMING TWO OPPOSITE EDGES OF A SINGLE WORKPIECE BY MACHINING, AND APPARATUS FOR IMPLEMENTING THE METHOD

[75] Inventor: Charles M. Simonetto, Le Perreux, France

[73] Assignee: Rene Tourolle et Fils (Societe A Responsabilite Limitee), France

[21] Appl. No.: 368,037

[22] Filed: Jun. 16, 1989

[30] Foreign Application Priority Data

Jun. 22, 1988 [FR] France ..... 88 08394

[51] Int. Cl.[5] ..... B21J 1/06; B21D 19/10

[52] U.S. Cl. ..... 72/38; 72/407; 72/453.02; 72/453.08; 72/342.94

[58] Field of Search ..... 72/407, 416, 412, 453.02, 72/453.01, 453.19, 38, 453.08, 342.94

[56] References Cited

U.S. PATENT DOCUMENTS

| | | | |
|---|---|---|---|
| 2,729,943 | 1/1956 | Clarke | 72/407 |
| 3,434,327 | 3/1969 | Speakman | 72/379 |
| 4,245,492 | 1/1981 | Clarke, Jr. | 72/407 |
| 4,248,075 | 2/1981 | Whitley | 72/416 |

FOREIGN PATENT DOCUMENTS

| | | | |
|---|---|---|---|
| 3150996 | 3/1983 | Fed. Rep. of Germany | 72/38 |
| 44153 | 1/1969 | Japan | 72/416 |
| 639623 | 12/1978 | U.S.S.R. | 72/38 |
| 988436 | 1/1983 | U.S.S.R. | 72/407 |
| 672070 | 5/1952 | United Kingdom | 72/407 |
| 694013 | 7/1953 | United Kingdom | 72/407 |
| 1391540 | 4/1975 | United Kingdom | 72/38 |

*Primary Examiner*—Daniel C. Crane

*Attorney, Agent, or Firm*—Brumbaugh, Graves, Donohue & Raymond

[57] ABSTRACT

A method of finishing two opposite edges (5, 6) of a single workpiece (1) by machining, the machining giving each edge a desired final shape by pressing the workpiece between a pair of tools (7, 8) having shapes (9, 10) complementary to the desired finished shapes for the two edges. According to the invention the complementary shapes (9, 10) of the tools (7, 8) are limited by causing them to correspond solely to the finishing zones (5a, 6a) of the two edges (5, 6), and during the finishing operation per se, the two tools are controlled to move simultaneously in translation (18–20, 19–21). The method is applicable to finishing holes through a high precision workpiece such as used in some jet engines.

3 Claims, 2 Drawing Sheets

METHOD OF DEFORMING TWO OPPOSITE EDGES OF A SINGLE WORKPIECE BY MACHINING, AND APPARATUS FOR IMPLEMENTING THE METHOD

The invention relates firstly to a method of finishing two opposite edges of a single workpiece by machining, such as the edges delimiting a cylindrical face of said workpiece, which face may be female or male, the machining giving each edge a desired final shape by pressing the workpiece between a pair of tools having shapes complementary to said desired finished shapes for the two edges.

BACKGROUND OF THE INVENTION

FR-A-2 455 489 describes a similar method, but which is limited to a very specialized application of machining relatively thin sheet that does not have the mechanical strength of workpieces machined in accordance with the present invention. In particular, in the prior art, one of the tools is fixed: if such means were used in implementing the method of the present invention, then the workpiece would be deformed in a manner incompatible with the desired machining accuracy.

At present, the kind of finishing machining to which the present invention applies is done by hand by workers who are particularly skilled, and in particular who are capable of polishing by grinding the edges of the two ends of each bore in a group of 50 to 100 bores through a fixing flange used in the manufacture of an aircraft jet engine, for example.

In spite of their competence and dexterity, it is clear that worker cannot ensure that the final shapes of edges finished in this way are completely uniform.

The invention therefore seeks to provide an addition to the above-specified method, thereby making the method suitable for obtaining machining accuracy and for avoiding any undesired deformation, while, naturally, ensuring that the repetitive nature of the machining is automated.

SUMMARY OF THE INVENTION

To this end, according to the invention, said complementary shapes of the tools are limited by causing them to correspond solely to the finishing zones of the two edges, and during the finishing operation per se, the two tools are controlled to move simultaneously in translation.

Advantageously, prior to pressing said two tools against the two said opposite edges, the zones of said two edges are subjected to surface nitriding.

The invention also provides apparatus for implementing the above-defined method and comprising a frame, two pressurized fluid actuators mounted on the frame, said actuators having respective moving components disposed facing each other and each supporting a corresponding one of said two tools, a source of fluid under pressure, and a selective pressurized fluid distribution valve disposed between the respective working chambers of the two actuators and the source of fluid under pressure, said working chambers being connected in parallel to the source of fluid under pressure via respective feed ducts in such a manner that efffective connection of said working chambers to said of fluid under pressure via said selective distribution device causes said simultaneous translation of the two tools.

Preferably, a rated delivery valve is placed on the feed duct to the working chamber of a first of said two actuators, in such a manner that when said effective connection is obtained via the selective distribution device, feed is applied initially to the second of said working chambers and is then provided to both working chambers simultaneously.

The advantages obtained by adopting the method of the invention are numerous, and include the following:

Firstly, ignoring tool wear, the same shape is obtained for edge after edge, such that the ideal shape can be obtained by repeating a repetitive mechanical operation instead of an operation of exceptional skill;

the time required for finishing an edge is reduced;

the surface state obtained is also improved, not only as to dimensions, but also with respect to roughness of the edge which, after finishing, is very small; and the material is additionally, in the vicinity of the edge, work-hardened, thereby improving the mechanical characteristics of the material, in particular its mechanical strength for withstanding surface stress, thus increasing the lifetime of the workpiece.

BRIEF DESCRIPTION OF THE DRAWINGS

Implementations of the invention are described by way of example with reference to the accompanying drawings, in which.

DETAILED DESCRIPTION

The machining operation from which the invention stems relates to certain fixing flanges included in high performance gas turbine engines, said flanges having numerous holes whose finishing must be done extremely carefully, in particular at the edges. The solution provided by the invention to the problem posed could, a priori, be applied to a machining problem similar to that mentioned above, namely: that of finishing the edges of a cylindrical workpiece, rather than the edges of a bore. The invention is equally applicable to finishing this second type of workpiece.

Two applications are described below, and the differences between the method of the invention and prior art methods are also mentioned.

Figure 1:
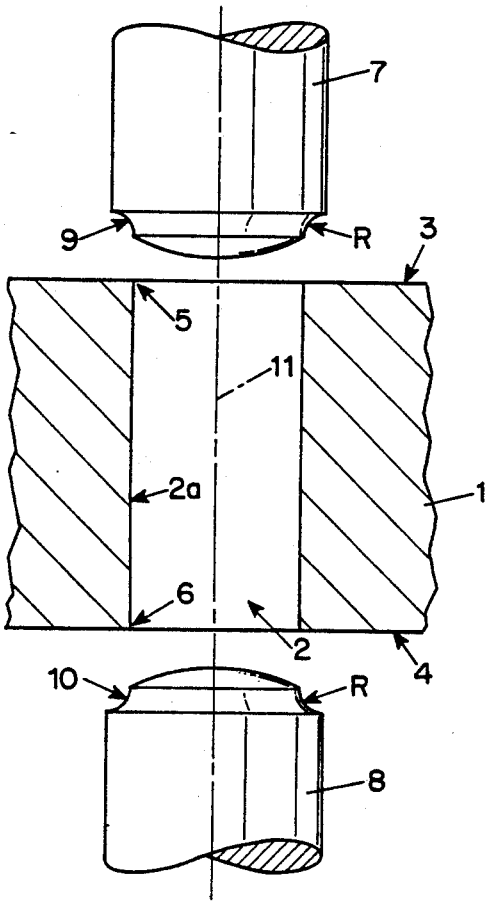
FIG. 1 is an axial section through a bore whose end edges have not yet been subjected to the finishing operation of the invention.
Figure 2:
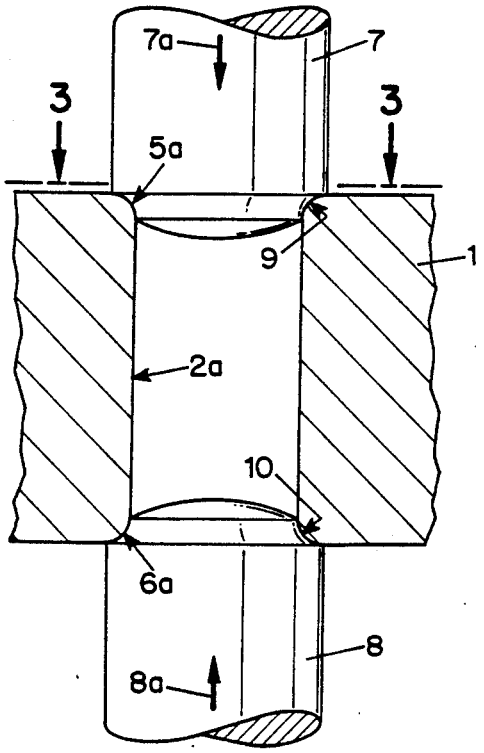
FIG. 2 is an axial section similar to that of FIG. 1 through the same workpiece, showing the edges being subjected to the finishing operation of the invention.
Figure 3:
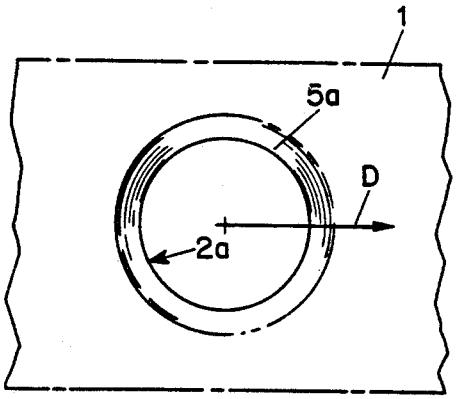
FIG. 3 is a section on line 3—3 of FIG. 2.

The first application is shown diagrammatically in FIGS. 1, 2, and 3.

With reference to FIG. 1, a workpiece 1 is already provided with a bore 2 which opens out in two parallel faces 3 and 4 delimiting said workpiece. The inside cylindrical face 2*a*of the bore intersects the faces 3 and 4 at edges 5 and 6, which, in the example shown, have already been de-burred. In the axial section of FIG. 1, the edges 5 and 6 are right-angle edges where the cylindrical face 2*a* intersects the plane faces 3 and 4.

A mandrel 7 or 8 is disposed facing each of the edges 5 and 6, and each mandrel is provided with a respective surface 9 or 10 which is toroidal in the present example and whose shape is complementary to the shape which the corresponding edge 5 or 6 is to take up after the mandrel has been pressed thereagainst.

The following points should now be observed:

as shown in FIG. 1, the radius of curvature R of each of the surfaces 9 and 10 and contained in a place including the axis 11 of the bore 2 (e.g. lying in the plane of FIG. 1), is relatively large: this is specifically for showing the shape of each of the surfaces 9 and 10 and its should be understood that in practice the radius R is considerably smaller than that shown in the figure;

in fact, the radius of curvature R is such that it may be specified that the general shape of the workpiece 1 is unaltered by having the mandrels 7 and 8 pressed against its edges 5 and 6, with the distance between the faces 3 and 4 remaining unchanged, as does the diameter of the bore 2 (except in the immediate vicinity of the edges 5 and 6);

in the example described, the section of FIG. 3 shows that the surface 2*a* has a circular right cross-section (and is otherwise plane): it should be observed that the invention is not limited to this particular form of cross-section, and in particular that it is equally applicable to finishing skew edges 5 and 6 (i.e. not contained in a plane) and which are not necessarily circular; and finally, both when the edges 5 and 6 are skew in shape and when they are plane and circular in shape, it should be observed that the mandrels 7 and 8 continue to point in the same direction relative to a given radial direction D (FIG. 3), with the final shape of the edges thus being obtained solely by applying the pressure due to the axial translation motion of the mandrels along the axis 11 of the bore 2.

The desired final shape for each edge is obtained from the configuration shown in FIG. 1 by displacing the two mandrels 7 and 8 by means of a press, and by applying compression forces 7*a* and 8*a* (FIG. 2) thereto to a value such that each edge takes up a finished shape 5*a* or 6*a* corresponding to the shape of the corresponding mandrel 9 or 10.

It may be observed that the two edges are shaped by applying pressure in two opposite directions (FIG. 2), and while this is clearly advantageous with respect to ensuring that both the workpiece 1 and the machine itself are in equilibrium during a finishing operation, it also has the advantage of avoiding undesirable deformation of the surface 2*a*, which deformation would otherwise obtain if only one of the two mandrels 7 and 8 were displaced.

In addition, prior to finishing by means of the mandrels 8 and 9, the edge zones 5 and 6 are subjected to a surface nitriding treatment down to a depth lying in the range 0.5 mm to 1.5 mm, for example. This nitriding treatment facilitates sliding of the faces 9 and 10 of the mandrels over the edges 5 and 6, and also over the finished shapes 5*a*, and 6*a* of said edges.

It should also be indicated that the material of the edges 5 and 6 is compressed by the mandrels 7 and 8 while lubrication is applied thereto simultaneously under very high pressure.

Figure 4:
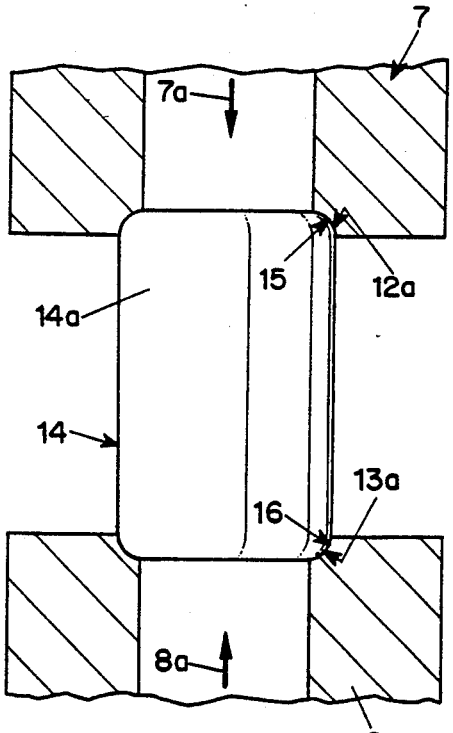
FIG. 4 is an axial section showing a cylindrical shaft whose end edges are being subjected to a finishing operation in accordance with the invention.

Naturally a method analogous to that described above could also be used for finishing the edges 12*a* and 13*a* of a cylindrical workpiece 14, still using mandrels 7 and 8, although the shape thereof should naturally be adapted, in particular the shapes of their surfaces 15 and 16 for finishing such edges 12*a* and 13*a* (see FIG. 4).

In real machining operations that have been performed, the compression forces 7*a* and 8*a* have been applied cold, i.e. without prior heating of the workpieces 1 or 14.

In the past, this type of finishing has been performed on workpieces made of materials which are relatively malleable: refractory alloys used in gas turbines and including about 50% chromium and/or nickel, or titanium, capable of elongation to 8%, or even more.

However, if heating is applied, workpieces made of other materials which are less malleable than those mentioned above could also have their edges finished in the manner described above.

Figure 5:
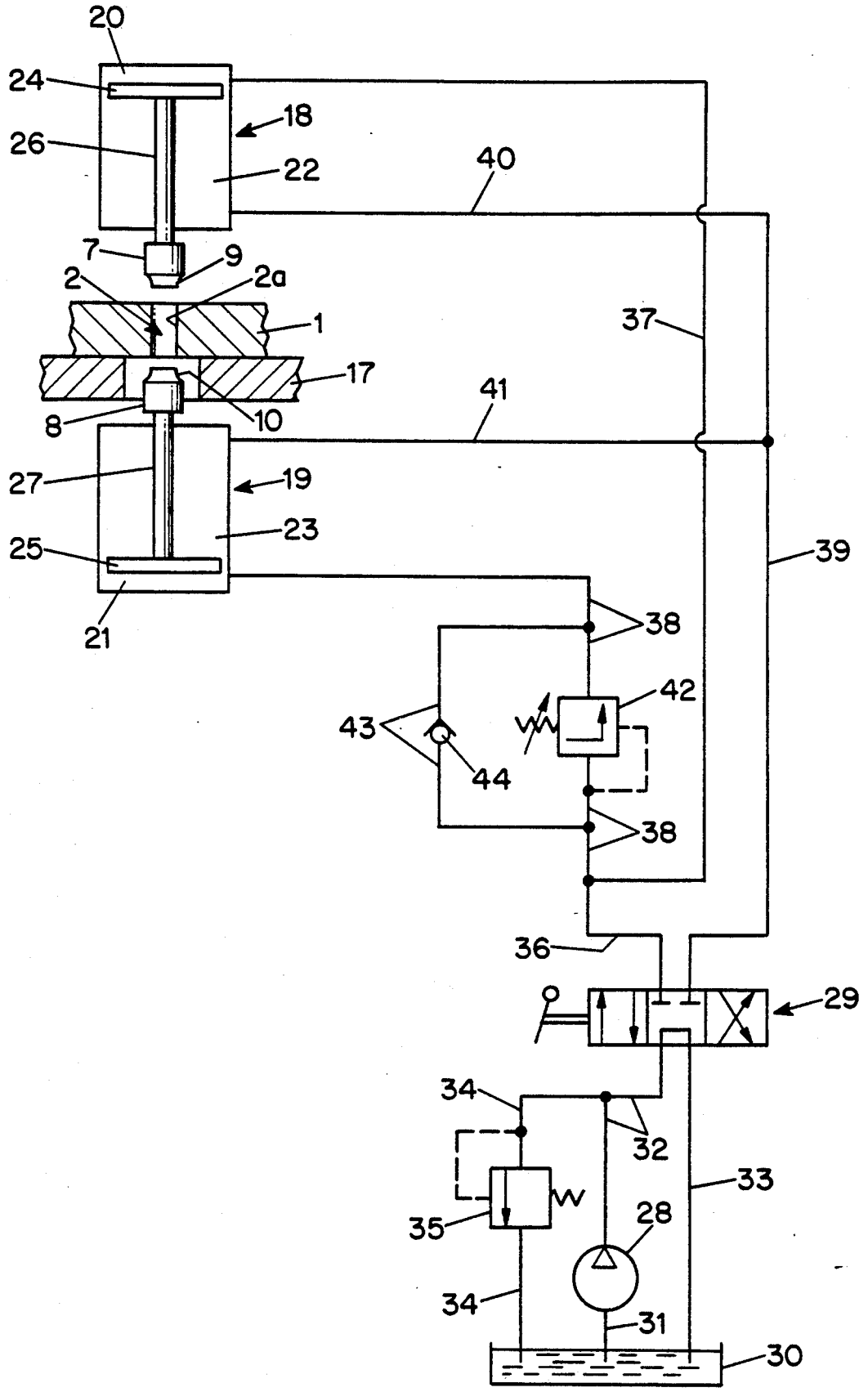
FIG. 5 is a diagram of a hydraulic control circuit for a machine in accordance with the invention.

FIG. 5 shows apparatus for controlling the respective translation displacement of the mandrels 7 and 8. This apparatus comprises:

two hydraulic actuators 18 and 19 whose cylinders are fixed to the frame 17 of the finishing machine and whose pistons 24 and 25 delimit two working chambers 20 and 21 inside said cylinders, said chambers being used for extending the actuators, together with two retraction chambers 22 and 23 for retracting said actuators, piston rods 26 and 27 being fixed to the pistons 24 and 25 and facing each other, said piston rods carrying respective ones of the mandrels 7 and 8;

a pump 28;

a three position fluid-distribution valve 29;

a fluid tank 30;

suction and delivery ducts 31 and 32 connecting the pump 28 to the tank 30 and to the fluid distribution valve 29;

a duct 33 connecting the fluid distribution valve 29 to the tank 30;

a duct 34 connecting the delivery duct 32 to the tank 30;

a delivery valve 35 for providing protection against excess pressure and rated at 350 bars disposed in the duct 34;

a duct 36 connected to the fluid distribution valve 29 and having two ducts 37 and 38 connected in parallel thereto, with the duct 37 being connected to the working chamber 20 and the other duct 38 being connected to the working chamber 21;

a duct 39 which is connected to the fluid distribution valve 29 and having two ducts 40 and 41 connected in parallel thereto, with the duct 40 being connected to retraction chamber 22 and with the other duct 41 being connected to the retraction chamber 23;

a delivery valve 42 rated to an average pressure, e.g. 50 bars, disposed on the duct 38 in order to allow fluid to pass towards the working chamber 21;

a duct 43 connected in parallel with the duct 38, bypassing the delivery valve 42; and a non-return valve 44 disposed on the duct 43 and allowing fluid to pass solely from the working chamber 21 towards the duct 36.

The three positions of the fluid distribution valve 29 are as follows:

a first position in which the ducts 32 and 36 are put into communication with each other as are the ducts 39 and 33;

a second position in which the ducts 32 and 33 are put into communication with each other while the ducts 36 and 39 are closed; and a third position in which the ducts 32 and 39 are put into communication with each other as are ducts 36 and 33.

This apparatus operates as explained above.

The workpiece 1 is placed on the frame 17 of the machine and rests freely thereon. The operator places the fluid distribution valve 29 in its first position, thereby directing fluid under pressure as delivered by the pump 28 into the ducts 36 and 37, and initially closing the duct 38 by means of the delivery valve 42, and naturally also closing the ducts 43 by means of the non-return valve 44. So long as the pressure in the duct 37 and in the top working chamber 20 does not reach the rated value (50 bars) of the delivery valve 42, only the actuator 18 is fed with fluid: only the mandrel 7 is displaced and it comes into contact with the workpiece 1. The pressure in the chamber 20 of actuator 18 and in the duct 37 increases as the mandrel 7 bears against the workpiece 1, until it reaches a value which exceeds the rated pressure of delivery valve 42.

Thereafter, both chambers 20 and 21 of the two actuators are fed in parallel with fluid under pressure, such that the two mandrels 7 and 8 move simultaneously towards each other and the edges 5 and 6 are shaped into edges 5*a* and 6*a*. Naturally, the edge-forming forces come into equilibrium and experience shows that this is the only disposition capable of avoiding the formation of undesirable deformations, e.g. in the face 2*a* of the bore or the face 14*a* of the workpiece 14.

The workpiece 1 is disengaged by placing the fluid distribution valve 29 in its third position and consequently by feeding fluid under pressure to chambers 22 and 23 of the actuators 18 and 19.

It should be observed that the mandrels 7 and 8 act only in the limited zone of the edges 5 and 6 (or 5*a* and 6*a*), and that they have no bearing surfaces extending perpendicularly to the translation axis 7*a*8*a*. In the method of the invention, the mandrels do not project sideways.

The main advantages of the finishing method described above are as follows:

the method is clearly capable of being automated and therefore requires no manual skills, no special ability on the part of the person performing the method, thereby increasing the ease with which the invention may be applied;

the shapes obtained for the edges are constant and as accurate as need be: they may be reproduced, identically, as many times as the application in question requires;

the surface state obtained is also excellent, and better than before;

the material is subjected to surface work-hardening in the vicinity of each edge, thereby improving its mechanical characteristics such that the lifetime of the finished workpiece is increased, even when subjected to repetitive stress cycles; a workpiece which withstood 10,000 stress cycles prior to the invention can now withstand 100,000 cycles;

a very considerable saving in time is obtained when finishing the edges; and the edges can be shaped, even with skew, non-plane curves without any undesirable deformation of the workpiece having said edges, and this is due to the compression forces being in equilibrium.

It is of interest to observe that the method of the invention is novel relative to:

stamping or upsetting which set out to change the general shape of a workpiece; burnishing in which a presser wheel is run over a surface but which does not, in theory, allow either repetivity or skew (non-plane) finished shapes to be obtained; and final shaping of previously roughed-out holes made in thin plates and having final dimensions that are not very accurate.

The invention is not limited to the embodiments described, but, on the contrary, covers any variant which may be applied thereto without going beyond the scope or the spirit of the invention.

I claim:

1. An apparatus for implementing the deformation of two opposite edges of a workpiece by machining, comprising:

a support frame, first and second pressurized fluid actuators mounted thereon in opposed relation, said actuators having a means for supporting and moving a machining tool, whereby the shape of the tool gives each edge a desired final shape by contacting the workpiece, said tools having shapes complementary to said desired deformed shapes for the two edges and wherein said complementary shapes of the tools correspond solely to the deformation zones of the two edges of the workpiece;

a workpiece support separate from the tools;

a source of fluid under pressure for actuating said actuators, said actuators having a working chamber and a retraction chamber for receiving the pressurized fluid and activating said actuators;

a selective pressurized fluid distribution valve connected between the working chambers of the first and second actuators, and the source of fluid under pressure, said working chambers being connected in parallel to the source of fluid under pressure via respective feed ducts so that effective connection of said working chambers via said selective distribution device causes simultaneous translation of the two tools; and a delivery valve rated to supply fluid when the fluid reaches a predetermined pressure, the delivery valve being located on the feed duct to the working chamber of one of said two actuators, in such a manner that when said effective connection is obtained via the selective distribution device, fluid is initially fed to one of said working chambers and thereafter to both working chambers simultaneously.

2. A method of deforming two opposite edges of a workpiece by machining comprising the steps of:

providing first and second pressurized fluid actuators oriented in opposed relation, supporting first and second machining tools having shapes complementary to the desired deformed shapes for the workpiece edges for movement by the actuators;

mounting said workpiece on a workpiece support separate from the tools;

applying an activating pressurized fluid initially to only one of the fluid actuators to move one of the tools, wherein the step of applying an activating pressurized fluid to one of the fluid actuators to move one of the tools comprises initially blocking the flow of activating pressurized fluid to the other actuator by locating a rated delivery valve in a supply line to the other of the actuators to cause initial fluid activation of the one actuator until fluid pressure increases to higher than a predetermined value at which the rated delivery valve passes the activating pressurized fluid to said other actuator; and subsequently applying said activating pressurized fluid to both of the actuators to cause simultaneous translation of the two tool during contact with the workpiece edges.

3. The method according to claim 2 further comprising the steps of subjecting at least the edges of the workpiece to be contacted by the tools to surface nitriding prior to contact by the tools.

* * * * *

UNITED STATES PATENT AND TRADEMARK OFFICE

CERTIFICATE OF CORRECTION

PATENT NO. : 5,024,075

DATED : June 18, 1991

INVENTOR(S) : SIMONETTO

It is certified that error appears in the above-identified patent and that said Letters Patent is hereby corrected as shown below:

Col. 1, line 65, "efffective" should read --effective--; line 66, after said insert -- source--.

Col. 3, line 9, "its" should read --it--;

Col. 4, line 13, "displacement" should read --displacements--;

Col. 5, line 30, "7a8a" should read --7a, 8a--;

Col. 6, line 62, "tool" should read --tools--; and

Col. 6, line 65, "steps" should read --step--.

Signed and Sealed this

Twenty-seventh Day of October, 1992

*Attest:*

DOUGLAS B. COMER

*Attesting Officer*

*Acting Commissioner of Patents and Trademarks*